US011098942B2

(12) United States Patent
Chao

(10) Patent No.: US 11,098,942 B2
(45) Date of Patent: Aug. 24, 2021

(54) REFRIGERATION DEVICE

(71) Applicants: Chien-Shun Chao, Taichung (TW); Xiangdong Shi, Beijing (CN)

(72) Inventor: Po-Han Chao, Taichung (TW)

(73) Assignees: Chien-Shun Chao, Taichung (TW); Xiangdong Shi, Beijing (CN)

( * ) Notice: Subject to any disclaimer, the term of this patent is extended or adjusted under 35 U.S.C. 154(b) by 103 days.

(21) Appl. No.: 16/705,594

(22) Filed: Dec. 6, 2019

(65) Prior Publication Data

US 2020/0378673 A1 Dec. 3, 2020

(30) Foreign Application Priority Data

May 27, 2019 (TW) ..... 108206641

(51) Int. Cl.
*F25D 3/00* (2006.01)

(52) U.S. Cl.
CPC ..... *F25D 3/00* (2013.01)

(58) Field of Classification Search
CPC ..... F25D 3/00; F25D 31/002; F25D 31/003; F25D 2331/811; F25D 2331/806; F25B 21/02; F25B 21/00; F25B 2321/02; F25B 2321/023; B65D 41/0492
See application file for complete search history.

(56) References Cited

U.S. PATENT DOCUMENTS 4,320,626 A * 3/1982 Donnelly ..... F25D 31/003 62/3.64
2008/0196415 A1* 8/2008 Lodge ..... A45F 3/20 62/3.64
2018/0105410 A1* 4/2018 Kim ..... B67D 3/0061
2018/0255966 A1* 9/2018 Moore ..... A47J 36/2461

* cited by examiner

*Primary Examiner* — Joseph F Trpisovsky
(74) *Attorney, Agent, or Firm* — Muncy, Geissler, Olds & Lowe, P.C.

(57) ABSTRACT

The present invention provides a refrigeration device, wherein a chamber structure is provided with a refrigeration space, and further fitted with a return outlet flow pipe and a return inlet flow pipe. Cold from a cold source produced by a refrigeration chip passes through a temperature equalization plate or a heat conducting pipe to enter the interior of a refrigeration space. A return inlet flow pipe of the refrigeration device is inserted into a beverage and used to input the beverage to the interior of the refrigeration space for cooling thereof. The beverage is then output from the inside of the refrigeration space through the return outlet flow pipe into a cup. The refrigeration device thus achieves fast cooling of a beverage to produce a cold drink. The refrigeration device can be applied in medical treatment, beds, and clothing, as well as medical equipment to provide a cooling function.

6 Claims, 8 Drawing Sheets

REFRIGERATION DEVICE

BACKGROUND OF THE INVENTION

(a) Field of the Invention

The present invention relates to a refrigeration device, and more specifically to a refrigeration device which is able to rapidly cool tea drinks, beer, beverages, coffee, and the like, without the need for ice cubes, thus preserving the original flavor of the drink and maintaining the undiluted original flavor. In addition, the device is small in size, has low power consumption, is convenient to use, and is of low cost, and thus suitable for use in general drinks shops, households, and for personal use; moreover, the refrigeration device can also be applied in medical treatment cooling. Furthermore, the refrigeration function of the chamber structure has multiple applications, such as in beds, clothing, and medical equipment.

(b) Description of the Prior Art

It is well known that companies producing bottled tea beverages on sale in the market mainly extract the protein from tea leaves to produce a cold tea drink, which is then sealed as a bottled beverage that can be stored for a long period of time, without the protein spoiling. However, the beverage has not been freshly made from tea leaves, after all, and many consumers are not willing to drink bottled tea beverages. Furthermore, current freshly made tea using tea leaves requires adding high temperature water to brew the tea leaves, thus, the tea being drunk is extremely hot. For those consumers fond of drinking cold tea, they can only add ice cubes to cool down the drink, which means the general drinks shops selling cold teas must add ice cubes to the tea drink after brewing the tea to rapidly lower the temperature thereof and produce the cold tea drink. However, a cold tea drink made in such a way has already diluted the essence and watered down the original flavor of the tea leaves. If the brewed tea drink is allowed to cool down from a high temperature and then placed in a refrigerator, then the further problem of storing the tea drink in the refrigerator for a length of time causes the protein in the tea drink to spoil, producing toxins that prevent the tea drink from being consumed. Moreover, it is not only the problems of tea drinks that are a source of distress for drinks vendors, freshly pressed fruit juice, freshly brewed coffee, and room temperature beer also need to have ice cubes added to cool them down, which results in diluting the original essence and losing the original flavor of the drinks. Hence, for those consumers fond of drinking cold beverages, they are only able to drink cold drinks that contain ice cubes, and miss out on the opportunity to taste the original essence and original flavor of beverages.

SUMMARY OF THE INVENTION

Cold drinks produced by cold drinks shops, regardless of whether they are freshly made tea drinks, freshly pressed fruit juices, or freshly brewed coffee, even room temperature beer, all require adding ice cubes to lower the temperature thereof. And adding ice cubes dilutes the original essence and oxidizes the beverage, which causes a deterioration in the taste or the beverage becomes bitter and astringent, resulting in a loss in the original flavor of the drink. For this reason, artificial flavors are continuously added to the drinks to improve their flavor, which perturbs drinks companies and consumers alike.

Accordingly, the present invention discloses a refrigeration device provided with a chamber structure comprising:

a refrigeration chip, which is provided with a refrigeration surface and a radiating surface, wherein a temperature equalization plate is fixedly positioned on the lower side of the refrigeration surface;

an upper cover, the top portion of which is provided with a top insert hole, which enables disposing the refrigeration chip therein;

an outlet and an inlet, which are provided at precalculated positions on the chamber structure, wherein the outlet enables connecting a return outlet flow pipe thereto, and the inlet enables connecting a return inlet flow pipe thereto;

an upper internal ring, which is positioned on the lower side of the upper cover and is provided with an outlet cylindrical concavity and an inlet cylindrical concavity;

a threaded internal ring, which is provided with a containing space, which enables embedding the upper internal ring therein, wherein the upper internal ring is clamped between a threaded internal ring and the upper cover; the threaded internal ring is provided with an outlet pipe hole and an inlet pipe hole, and a bottom circumferential periphery of the threaded internal ring is provided with an external screw thread;

a threaded bottom cover, which is provided with an internal screw thread and a refrigeration space, which enable fixedly positioning the threaded internal ring therein; the threaded bottom cover is provided with an upper circumferential ring that is covered by the upper cover; and at least one leak stoppage ring, which is positioned between the threaded internal ring and the threaded bottom cover.

Accordingly, cold from a cold source of the refrigeration surface of the refrigeration chip is conducted from the temperature equalization plate into the interior of the refrigeration space, whereupon the return inlet flow pipe is inserted into a beverage and used to input the beverage to the interior of the refrigeration space for cooling thereof. The return outlet flow pipe is then used to output the beverage inside the refrigeration space into a cup, thereby achieving the object of cooling a beverage to produce a cold drink.

The primary object of the present invention lies in providing a small-scale chamber structure, within which is introduced a beverage to achieve a cooling function thereof, after which the beverage is output into a cup for a person to drink. Using such a method enables cooling tea drinks, beer, beverages, and the like, without the need for ice cubes, thus preserving the original flavor of the drink and maintaining the undiluted original flavor. In addition, the device is small in size, has low power consumption, is convenient to use, and is of low cost, and thus suitable for use in general drinks shops, households, and for personal use; moreover, the refrigeration device can also be applied in medical treatment cooling. Furthermore, the refrigeration function of the chamber structure has multiple applications, such as in beds, clothing, and medical equipment.

A second object of the present invention lies in providing a function that enables multiple cycles of cooling down a beverage to achieve the required degree of cooling for the consumer.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
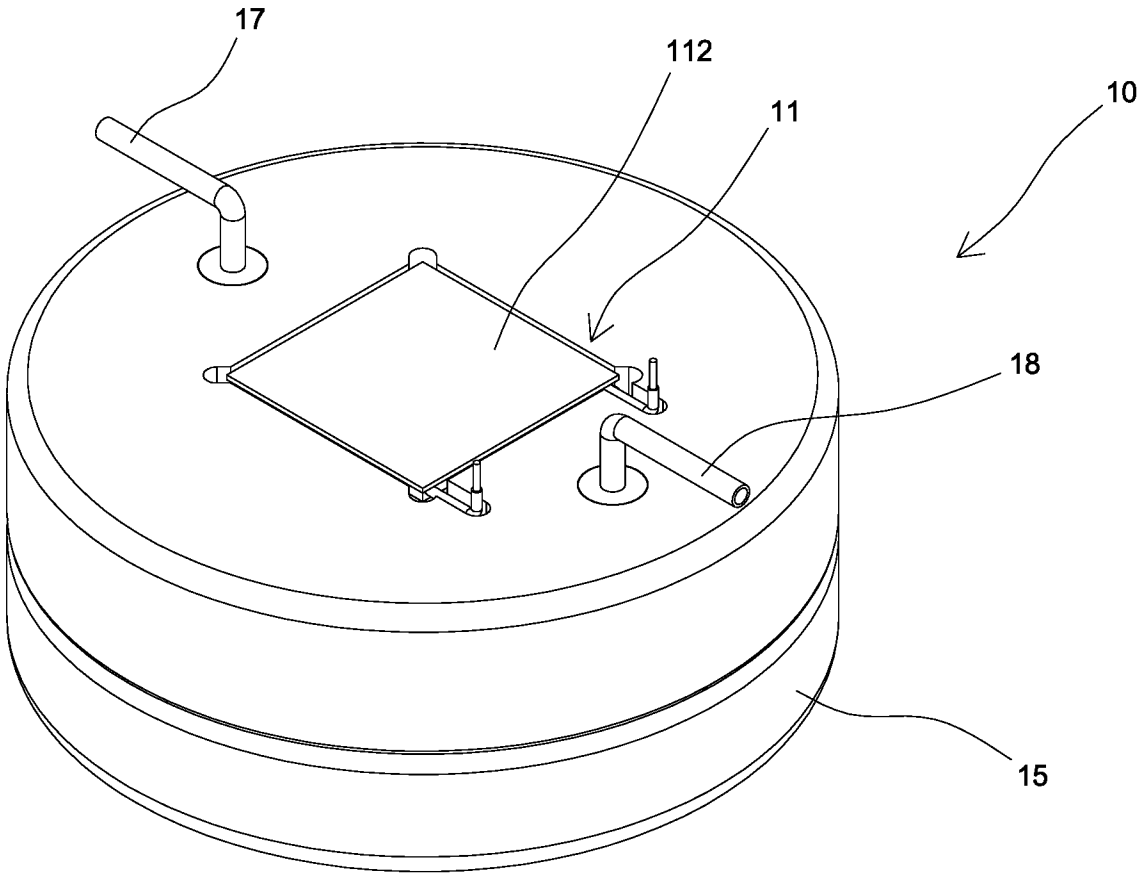
FIG. 1 is a three-dimensional schematic view of a first embodiment of the present invention.
Figure 2:
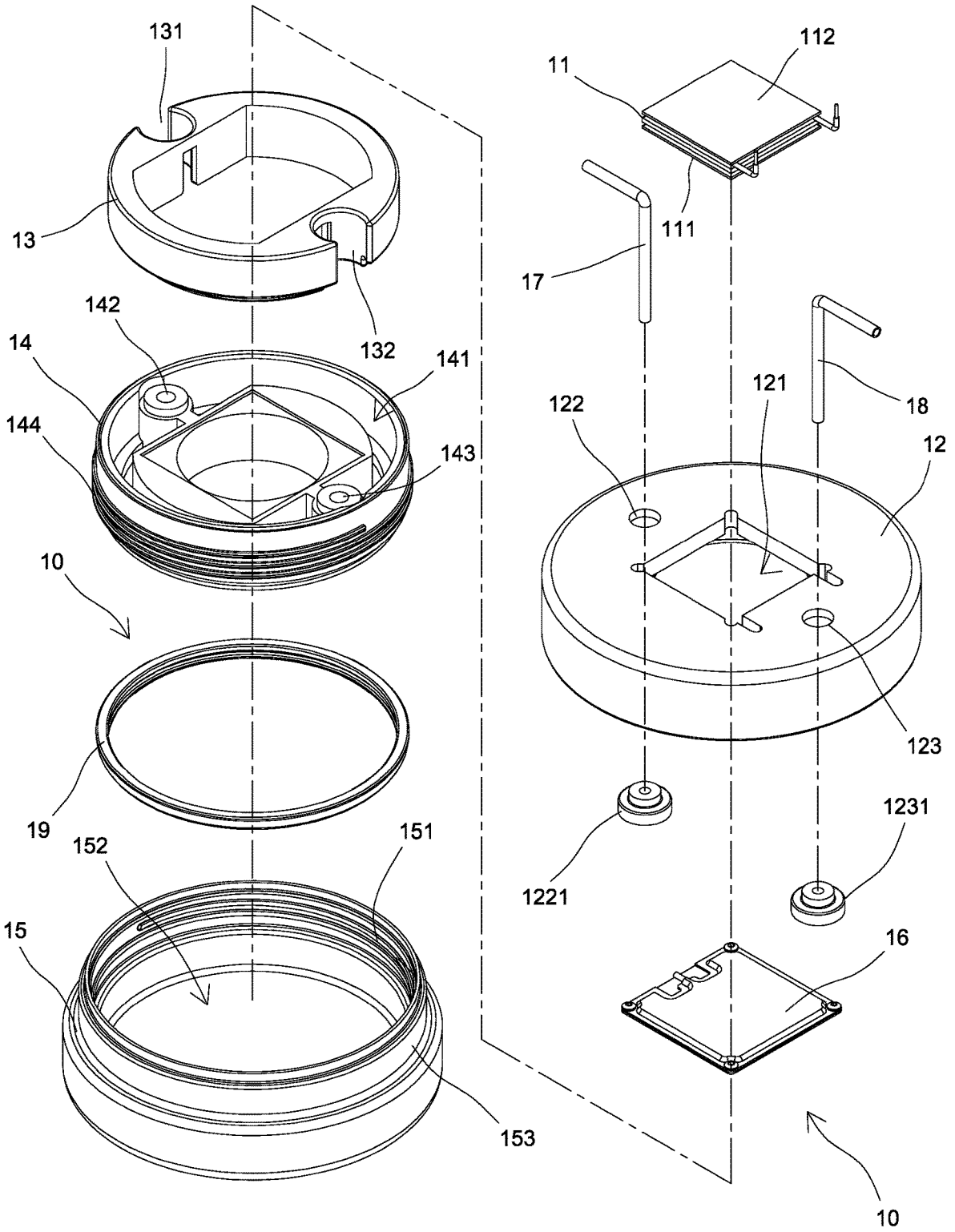
FIG. 2 is an exploded three-dimensional schematic view of the first embodiment of the present invention.
Figure 3:
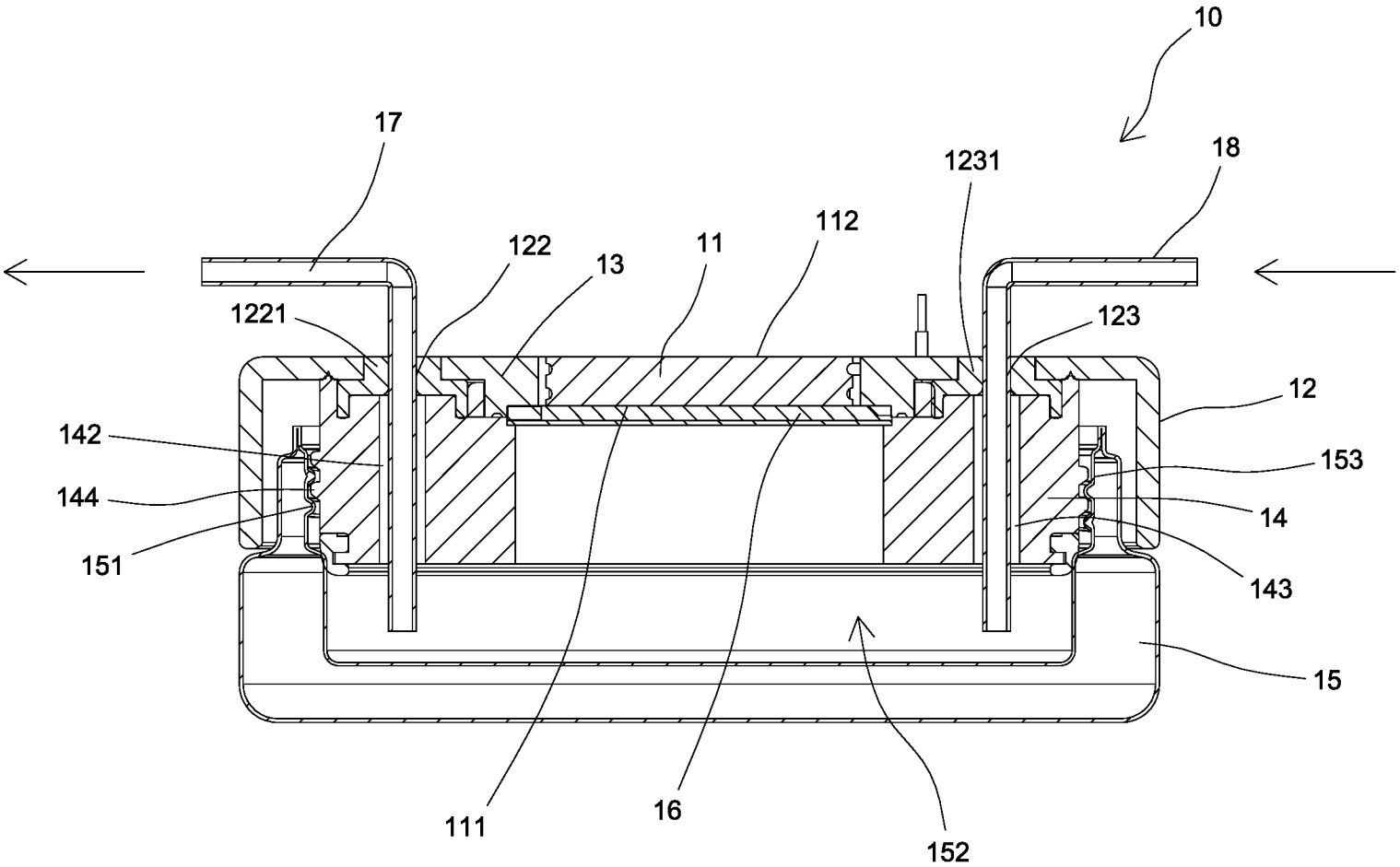
FIG. 3 is a cross-sectional schematic view of the first embodiment of the present invention.

Referring to FIGS. 1 to 3, which show a first embodiment of the present invention, wherein a chamber structure 10 is provided with a small depth. The chamber structure 10 comprises a refrigeration chip 11, an upper cover 12, an upper internal ring 13, a threaded internal ring 14, and a threaded bottom cover 15. The refrigeration chip 11 further comprises a refrigeration surface 111 and a radiating surface 112. The refrigeration chip 11 is also fitted with a switch that has an external connection power cord and a control IC (integrated circuit), which are well known to those of skill in the art and not further detailed herein. A temperature equalization plate 16 is fixedly positioned on the lower side of the refrigeration surface 111, and the top portion of the upper cover 12 is provided with a top insert hole 121, which enables disposing the refrigeration chip 11 therein. The refrigeration surface 111 faces downward and the radiating surface 112 faces upward. The upper cover 12 is provided with an outlet 122 and an inlet 123, and a first holding ring 1221 is inserted into the outlet 122 to enable passing and connecting a return outlet flow pipe 17 therein. Moreover, a second holding ring 1231 is inserted into the inlet 123 to enable passing and connecting a return inlet flow pipe 18 therein. The upper internal ring 13 is positioned on the lower side of the upper cover 12 and is provided with an outlet cylindrical concavity 131 and an inlet cylindrical concavity 132. The threaded internal ring 14 is provided with a containing space 141, which enables embedding the upper internal ring 13 therein, and the upper internal ring 13 is clamped between the threaded internal ring 14 and the upper cover 12. The threaded internal ring 14 is further provided with an outlet pipe hole 142 and an inlet pipe hole 143, wherein the outlet cylindrical concavity 131 of the upper internal ring 13 clasps round the periphery of the outlet pipe hole 142, and the inlet cylindrical concavity 132 clasps round the periphery of the inlet pipe hole 143. The return outlet flow pipe 17 penetrates the outlet 122 of the upper cover 12 and the outlet pipe hole 142 of the threaded internal ring 14; the return inlet flow pipe 18 penetrates the inlet 123 of the upper cover 12 and the inlet pipe hole 143 of the threaded internal ring 14. A bottom circumferential periphery of the threaded internal ring 14 is provided with an external screw thread 144, and the threaded bottom cover 15 is provided with an internal screw thread 151 and a refrigeration space 152, which enable fixedly positioning the threaded internal ring 14 therein. The threaded bottom cover 15 is provided with an upper circumferential ring 153 that is covered using the upper cover 12, and a leak stoppage ring 19 is positioned between the threaded internal ring 14 and the threaded bottom cover 15. The upper cover 12, the upper internal ring 13, the threaded internal ring 14, and the threaded bottom cover 15 are all made from thermal insulation material.

According to the above-described structural assembly, the first embodiment of the present invention uses the refrigeration surface 111 of the refrigeration chip 11 to produce a cold source and concurrently uses the radiating surface 112 to produce a heat source, from which heat is transmitted and dissipated to the external environment, or an additional heat pipe and heat dissipating fins are used to dissipate the heat source (not shown in the drawings). Cold from the cold source of the refrigeration surface 111 is conducted to the temperature equalization plate 16, which enables cooling the refrigeration space 152 of the threaded bottom cover 15, whereupon the refrigeration space 152 gradually cools down, and after a period of time, the return inlet flow pipe 18 is inserted into a beverage and used to input the beverage to the interior of the refrigeration space 152 for cooling thereof. The return outlet flow pipe 17 is then used to output the beverage from inside the refrigeration space 152 to the interior of a cup ready for a person to drink, (wherein a small pump is used to output the beverage to the cup; the small pump is well known to those of skill in the art, and is not shown in the drawings).

If an even colder drink is required, then the return inlet flow pipe 18 and the return outlet flow pipe 17 can be concurrently inserted into the beverage, whereby the return inlet flow pipe 18 is used to input the beverage to the interior of the refrigeration space 152 for cooling thereof, and then the return outlet flow pipe 17 is used to output the beverage from inside the refrigeration space 152 to the interior of a beverage canister, after which the beverage is input to the interior of the refrigeration space 152 using the return inlet flow pipe 18 for further cooling of the beverage. Through such a cyclic process involving continual and repeated cooling of the beverage inside the refrigeration space 152 using the temperature equalization plate 16, the required degree of cooling for the cold drink is achieved. The beverage is then extracted and output from the return outlet flow pipe 17 to the interior of a cup ready for a person to drink. Using such a method enables cooling tea drinks, beer, beverages, and the like, without the need for ice cubes, thus preserving the original flavor of the drink and maintaining the undiluted original flavor. In addition, the refrigeration device is small in size, has low power consumption, is convenient to use, and is of low cost, and thus suitable for use in general drinks shops, households, and for personal use; moreover, the refrigeration device can also be applied in medical treatment cooling. Furthermore, the refrigeration function of the chamber structure 10 has multiple applications, such as in beds, clothing, and medical equipment.

Figure 4:
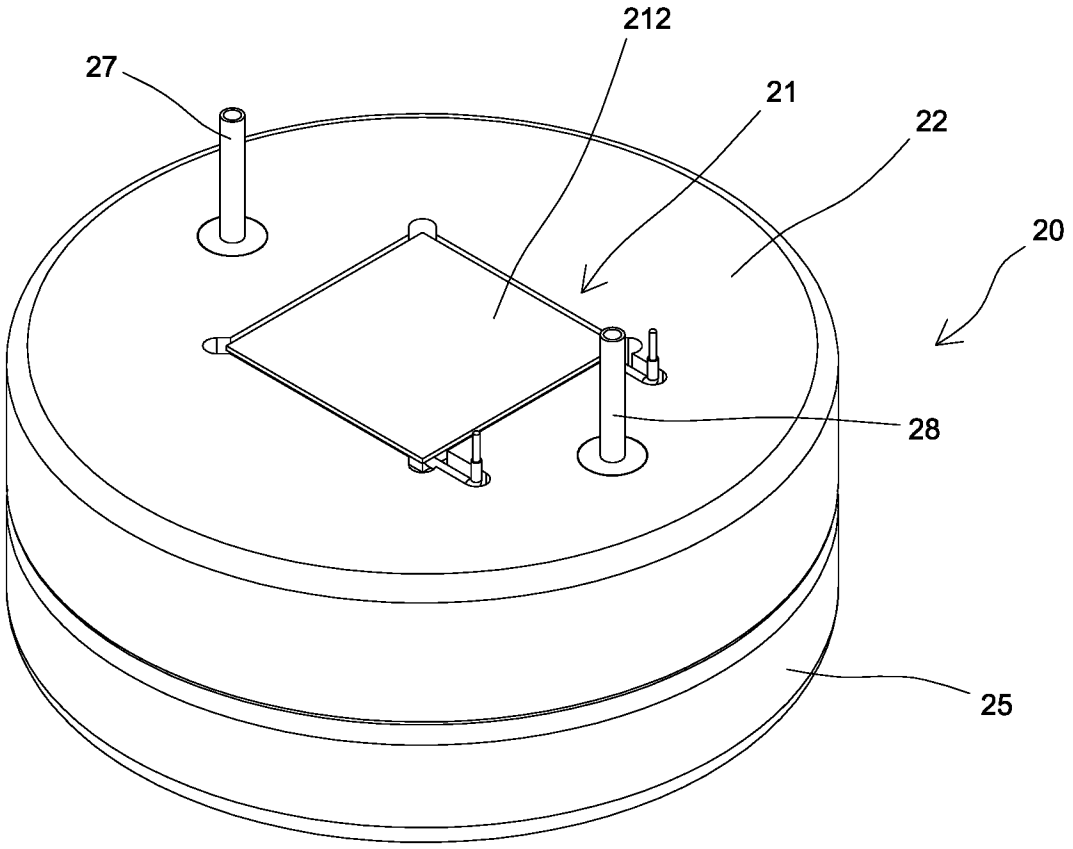
FIG. 4 is a three-dimensional schematic view of a second embodiment of the present invention.
Figure 5:
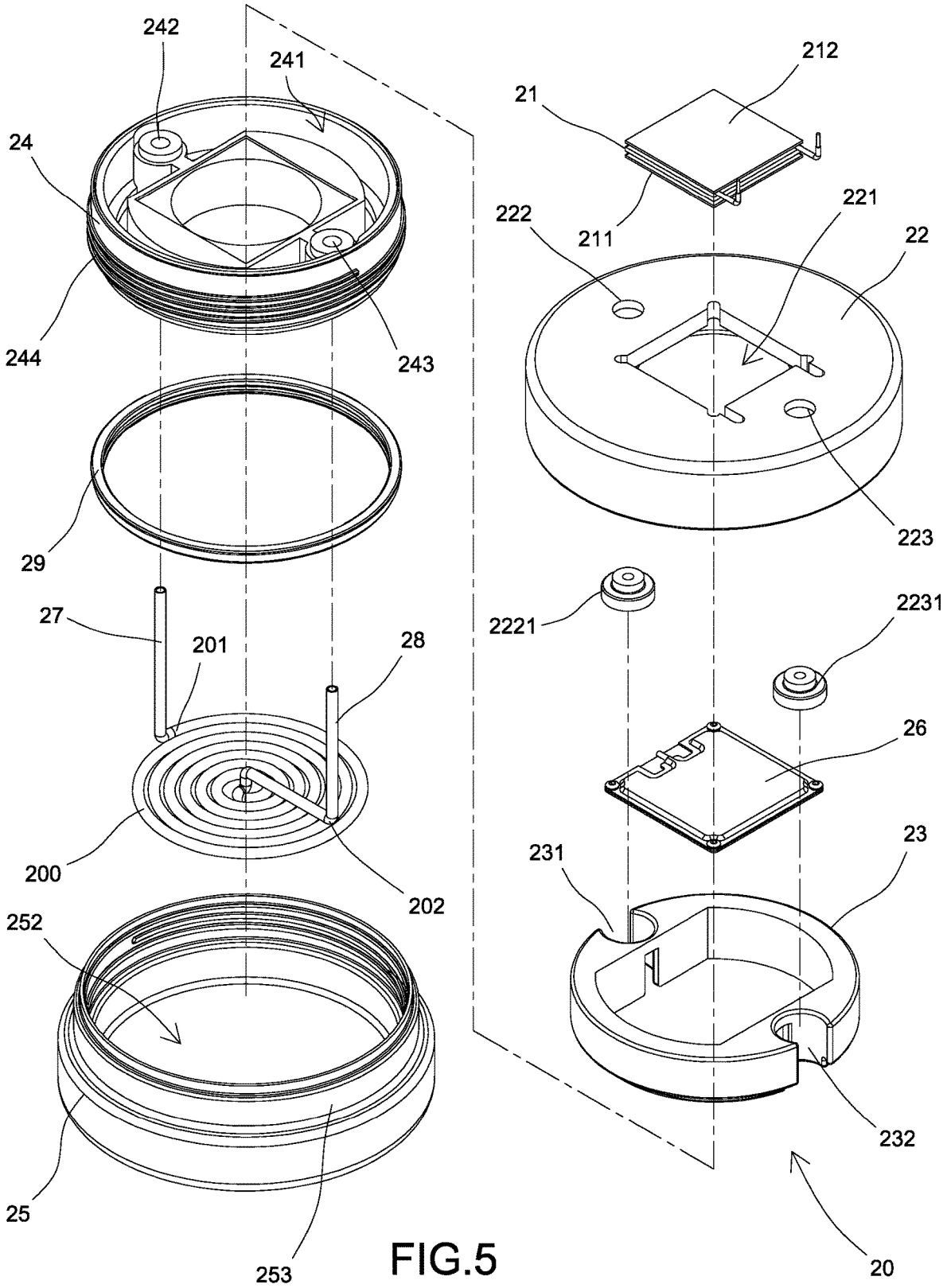
FIG. 5 is an exploded three-dimensional schematic view of the second embodiment of the present invention.
Figure 6:
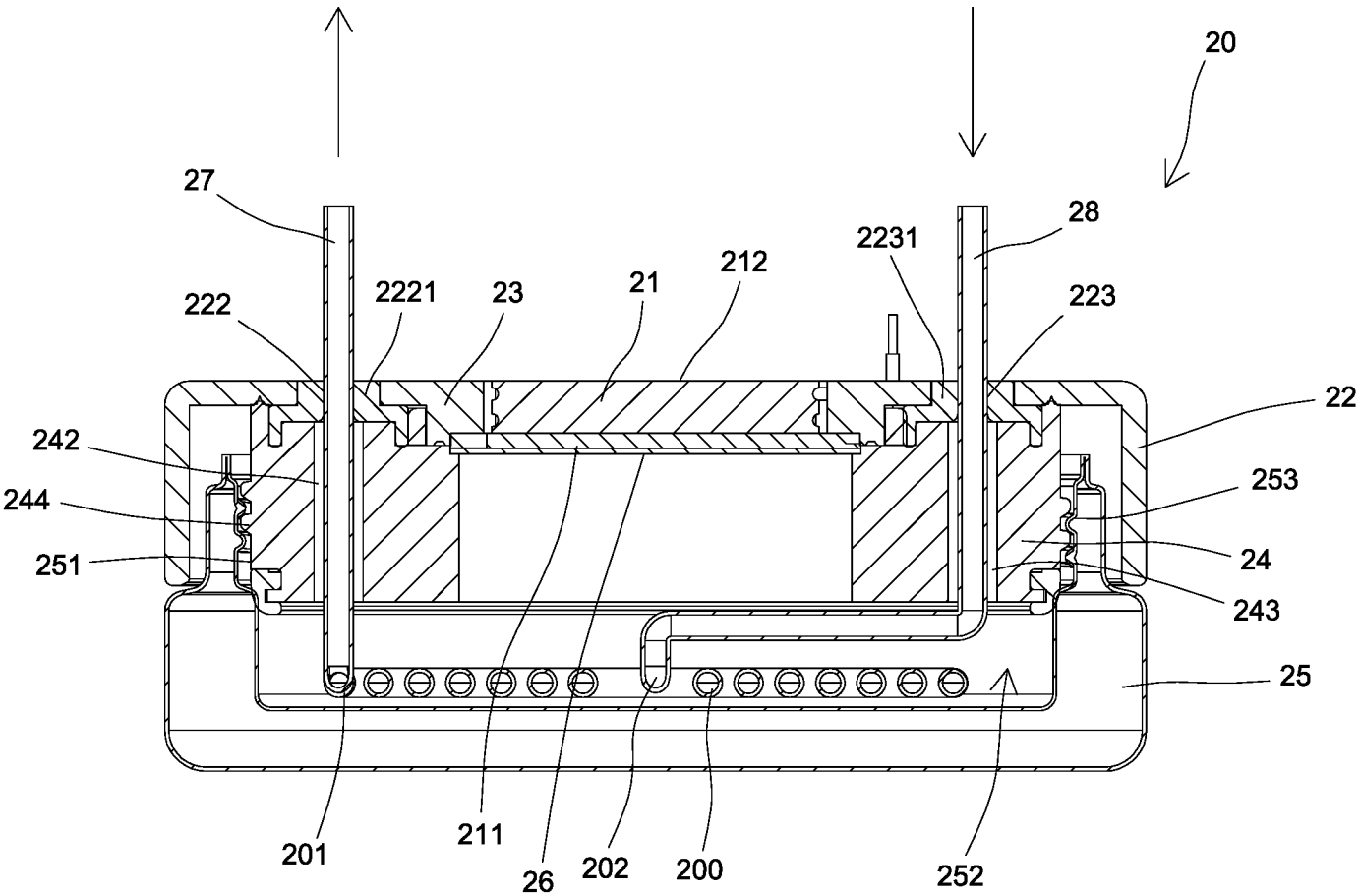
FIG. 6 is a cross-sectional schematic view of the second embodiment of the present invention.

Referring to FIGS. 4 to 6, which show a second embodiment of the present invention, wherein a chamber structure 20 is provided with a small depth. The chamber structure 20 comprises a refrigeration chip 21, an upper cover 22, an upper internal ring 23, a threaded internal ring 24, and a threaded bottom cover 25. The refrigeration chip 21 comprises a refrigeration surface 211 and a radiating surface 212. The refrigeration chip 21 is also fitted with a switch that has an external connection power cord and a control IC, which are well known to those of skill in the art and not further detailed herein. A temperature equalization plate 26 is fixedly positioned on the lower side of the refrigeration surface 211. The top portion of the upper cover 22 is provided with a top insert hole 221, which enables disposing the refrigeration chip 21 therein. The refrigeration surface 211 faces downward and the radiating surface 212 faces upward. The upper cover 22 is further provided with an outlet 222 and an inlet 223, wherein a first holding ring 2221 is inserted into the outlet 222 to enable passing and connecting a return outlet flow pipe 27 therein, and a second holding ring 2231 is inserted into the inlet 223 to enable passing and connecting a return inlet flow pipe 28 therein. The upper internal ring 23 is positioned on the lower side of the upper cover 22, and the upper internal ring 23 is provided with an outlet cylindrical concavity 231 and an inlet cylindrical concavity 232. The threaded internal ring 24 is provided with a containing space 241, which enables embedding the upper internal ring 23 therein, and the upper internal ring 23 is clamped between the threaded internal ring 24 and the upper cover 22. The threaded internal ring 24 is also provided with an outlet pipe hole 242 and an inlet pipe hole 243, wherein the outlet cylindrical concavity 231 of the upper internal ring 23 clasps round the periphery of the outlet pipe hole 242, and the inlet cylindrical concavity 232 clasps round the periphery of the inlet pipe hole 243. The return outlet flow pipe 27 penetrates the outlet 222 of the upper cover 22 and the outlet pipe hole 242 of the threaded internal ring 24. And the return inlet flow pipe 28 penetrates the inlet 223 of the upper cover 22 and the inlet pipe hole 243 of the threaded internal ring 24. A bottom circumferential periphery of the threaded internal ring 24 is provided with an external screw thread 244, and the threaded bottom cover 25 is provided with an internal screw thread 251 and a refrigeration space 252, which enable fixedly positioning the threaded internal ring 24 therein. The threaded bottom cover 25 is provided with an upper circumferential ring 253 that is covered using the upper cover 22. A leak stoppage ring 29 is positioned between the threaded internal ring 24 and the threaded bottom cover 25. The refrigeration space 252 is filled with cooling liquid, and a superconducting pipe 200 is disposed into the interior of the refrigeration space 252, wherein the superconducting pipe 200 is a coplanar multiple ring configuration. One end 201 of the superconducting pipe 200 is connected to the bottom end of the return outlet flow pipe 27, and another end 202 of the superconducting pipe 200 is connected to the bottom end of the return inlet flow pipe 28. The upper cover 22, the upper internal ring 23, the threaded internal ring 24, and the threaded bottom cover 25 are all made from thermal insulation material.

The second embodiment of the present invention uses the refrigeration surface 211 of the refrigeration chip 21 to produce a cold source and concurrently uses the radiating surface 212 to produce a heat source, which transmits and dissipates heat to the external environment, or an additional connected heat pipe and heat dissipating fins are used to dissipate heat from the heat source. Cold from the cold source of the refrigeration surface 211 is conducted to the temperature equalization plate 26, which cools the cooling liquid inside the refrigeration space 252. The superconducting pipe 200 is gradually cooled down by the cooling liquid after a period of time, whereupon the return inlet flow pipe 28 is inserted into a beverage and used to input the beverage to inside the superconducting pipe 200 positioned in the refrigeration space 252. The cooling liquid lowers the temperature of the beverage, after which, the beverage is output from inside the refrigeration space 252 through the return outlet flow pipe 27 to the interior of a cup ready for a person to drink.

In the second embodiment of the present invention, if an even colder drink is required, then the return inlet flow pipe 28 and the return outlet flow pipe 27 can be concurrently inserted into the beverage, whereby the return inlet flow pipe 28 is used to input the beverage to the interior of the refrigeration space 252, whereupon the cooling liquid lowers the temperature of the beverage. The return outlet flow pipe 27 is then used to output the beverage from inside the refrigeration space 252 to the interior of a beverage canister and the return inlet flow pipe 28 is used to input the beverage to inside the superconducting pipe 200 positioned in the refrigeration space 252, whereupon the cooling liquid further lowers the temperature of the beverage. Accordingly, the required degree of cooling for the cold drink is achieved through a continuous and repeated cyclic cooling down process of the beverage using the temperature equalization plate 26. The beverage is then extracted and output from the return outlet flow pipe 27 to the interior of a cup ready for a person to drink. Using such a method enables cooling tea drinks, beer, beverages, and the like, without the need for ice cubes, thus preserving the original flavor of the drink and maintaining the undiluted original flavor. In addition, the refrigeration device is small in size, has low power consumption, is convenient to use, and is of low cost, and thus suitable for use in general drinks shops, households, and for personal use; moreover, the refrigeration device can also be applied in medical treatment cooling. Furthermore, the refrigeration function of the chamber structure 20 has multiple applications, such as in beds, clothing, and medical equipment.

Figure 7:
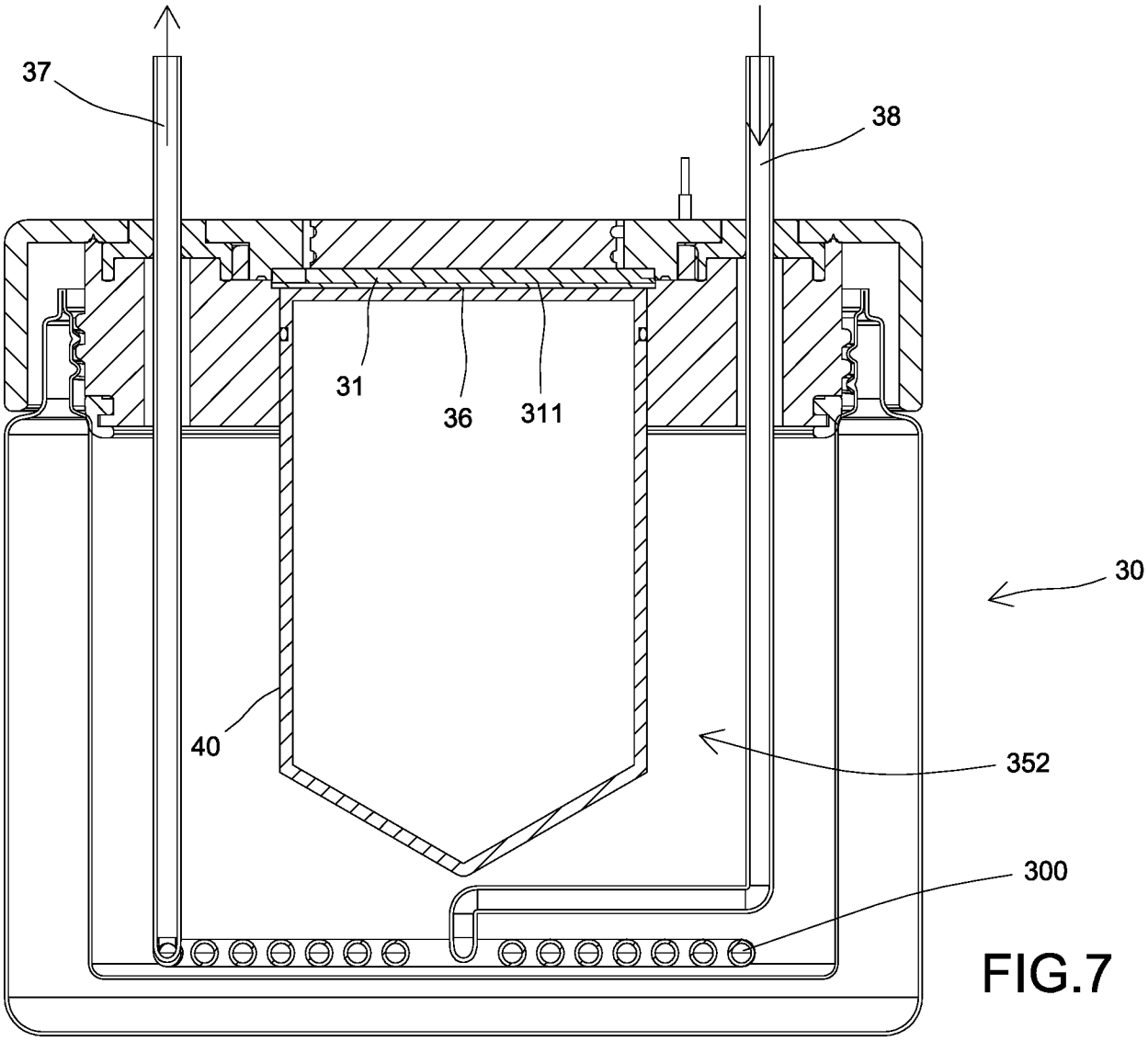
FIG. 7 is a cross-sectional schematic view of a third embodiment of the present invention.

Referring to FIG. 7, which shows a third embodiment of the present invention, wherein the height of a chamber structure 30 is increased, a refrigeration space 352 within the chamber structure is thus enlarged, and a heat conducting pipe 40 and a superconducting pipe 300 are fixedly positioned inside the refrigeration space 352, wherein the superconducting pipe 300 is a coplanar multi ring configuration. A refrigeration surface 311 of a refrigeration chip 31 produces a cold source, and the heat conducting pipe 40 and a temperature equalization plate 36 cool a cooling liquid inside the refrigeration space 352. A return inlet flow pipe 38 and a return outlet flow pipe 37 are both inserted into a beverage, whereupon the return inlet flow pipe 38 is used to input the beverage to the interior of the refrigeration space 352, at which time the cooling liquid lowers the temperature of the beverage, which is then output from the return outlet flow pipe 37 to the interior of a beverage canister from the inside of the refrigeration space 352, and then the return inlet flow pipe 38 again inputs the beverage to inside the superconducting pipe 300 positioned in the refrigeration space 352 to further lower the temperature of the beverage using the cooling liquid. Accordingly, the heat conducting pipe 40 and the temperature equalization plate 36 are used to continually and repeatedly cool down the beverage, and through such a cyclic process, the required degree of cooling for the cold drink is achieved. Finally, the beverage is extracted and output from the return outlet flow pipe 37 to the interior of a cup ready for a person to drink. Using such a method enables cooling tea drinks, beer, beverages, and the like, without the need for ice cubes. In the same manner, the device can also be applied in medical treatment cooling; moreover, the refrigeration function of the chamber structure 30 has multiple applications, such as in beds, clothing, and medical equipment.

Figure 8:
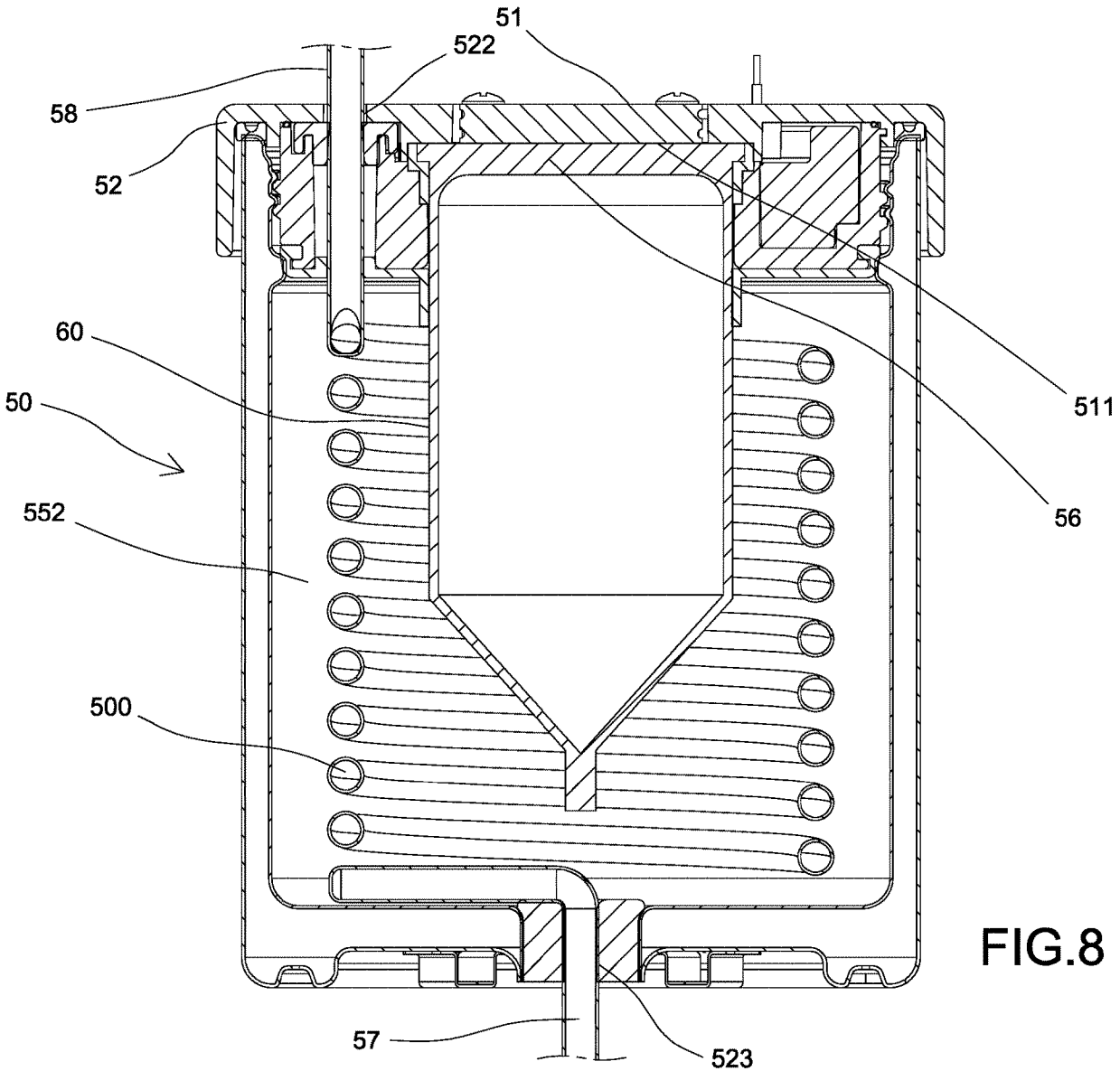
FIG. 8 is a cross-sectional schematic view of a fourth embodiment of the present invention.

Referring to FIG. 8, which shows a fourth embodiment of the present invention, wherein an inlet 522 is provided in an upper cover 52; moreover, an outlet 523 is provided in the bottom portion of a chamber structure 50, and a return outlet flow pipe 57 is repositioned on the lower side of the chamber structure 50. The position of a return inlet flow pipe 58 is as above-described, and to accommodate circumstantial needs, the chamber structure 50 is still provided with additional height. A heat conducting pipe 60 is fixedly positioned inside a refrigeration space 552. The heat conducting pipe 60 is a closed cycle type of heat conducting pipe, the upper portion of which contacts a temperature equalization plate 56. A superconducting pipe 500 is a helical multi-ring configuration, which is positioned inside the refrigeration space 552. A refrigeration surface 511 of a refrigeration chip 51 produces a cold source. The heat conducting pipe 60 and the temperature equalization plate 56 are used to cool a cooling liquid inside the refrigeration space 552, and both the return inlet flow pipe 58 and the return outlet flow pipe 57 are inserted into a beverage, whereupon the return inlet flow pipe 58 is used to input the beverage to the interior of the refrigeration space 552. The cooling liquid is used to lower the temperature of the beverage, which is then output from the return outlet flow pipe 57 to the interior of a beverage canister from inside the refrigeration space 552, and the return inlet flow pipe 58 is used to re-input the beverage to inside the superconducting pipe 500 positioned in the refrigeration space 552, using the cooling liquid to further lower the temperature. The heat conducting pipe 60 and the temperature equalization plate 56 are used to continually and repeatedly cool down the beverage, and through such a cyclic process, the required degree of cooling for the cold drink is achieved, at which time the beverage is extracted and output from the return outlet flow pipe 57 to the interior of a cup ready for a person to drink. Using such a method enables cooling tea drinks, beer, beverages, and the like, without the need for ice cubes. In the same manner, the device can also be applied in medical treatment cooling; moreover. the refrigeration function of the chamber structure 50 has multiple applications, such as in beds, clothing, and medical equipment.

In addition, the positive and negative poles of the power supply for the refrigeration chip can be interchanged in all of the above-described embodiments to provide the refrigeration device with the capability to function as a heating device. Such a heating function enables maintaining the temperature required to thermally insulate a beverage, while preventing the temperature of the beverage from dropping. Accordingly, the device can be transformed to produce the required temperature function.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A refrigeration device, wherein a chamber structure comprises:

a refrigeration chip, which is provided with a refrigeration surface and a radiating surface, a temperature equalization plate is fixedly positioned on the lower side of the refrigeration surface;

an upper cover, the top portion of which is provided with a top insert hole, which enables disposing the refrigeration chip therein;

an outlet and an inlet, which are provided at precalculated positions on the chamber structure, wherein the outlet enables connecting a return outlet flow pipe thereto, and the inlet enables connecting a return inlet flow pipe thereto;

an upper internal ring, which is positioned on the lower side of the upper cover and is provided with an outlet cylindrical concavity and an inlet cylindrical concavity;

a threaded internal ring, which is provided with a containing space, which enables embedding the upper internal ring therein, wherein the upper internal ring is clamped between the threaded internal ring and the upper cover; the threaded internal ring is provided with an outlet pipe hole and an inlet pipe hole, and a bottom circumferential periphery of the threaded internal ring is provided with an external screw thread;

a threaded bottom cover, which is provided with an internal screw thread and a refrigeration space, which enable fixedly positioning the threaded internal ring therein; the threaded bottom cover is provided with an upper circumferential ring that is covered by the upper cover; and at least one leak stoppage ring, which is positioned between the threaded internal ring and the threaded bottom cover;

whereby cold from a cold source of the refrigeration surface of the refrigeration chip is conducted from the temperature equalization plate into the interior of the refrigeration space, whereupon the return inlet flow pipe is inserted into a beverage and used to input the beverage to the interior of the refrigeration space for cooling thereof; the return outlet flow pipe is then used to output the beverage inside the refrigeration space into a cup, thereby cooling the beverage to produce a cold drink.

2. The refrigeration device according to claim 1, wherein the inlet and the outlet are provided on the upper cover, a first holding ring is inserted into the outlet and a second holding ring is inserted into the inlet; the first holding ring and the second holding ring respectively bind the return outlet flow pipe and the return inlet flow pipe.

3. The refrigeration device according to claim 1, wherein the upper cover, the upper internal ring, the threaded internal ring, and the threaded bottom cover are all made from thermal insulation material.

4. The refrigeration device according to claim 1, wherein the refrigeration space is filled with a cooling liquid, and a superconducting pipe is disposed in the interior of the refrigeration space; the superconducting pipe is a coplanar multi ring configuration, one end of which is connected to the bottom end of the return outlet flow pipe and another end is connected to the bottom end of the return inlet flow pipe.

5. The refrigeration device according to claim 1, wherein the height of the chamber structure is increased, and the enlarged refrigeration space formed therefrom is filled with a cooling liquid; a heat conducting pipe is further fixedly positioned inside the refrigeration space, wherein the heat conducting pipe is a closed cycle type, the upper portion of which contacts the temperature equalization plate, and a superconducting pipe is disposed in the interior of the refrigeration space; the superconducting pipe is a coplanar multi ring configuration, one end of which is connected to the bottom end of the return outlet flow pipe and another end is connected to the bottom end of the return inlet flow pipe.

6. The refrigeration device according to claim 1, wherein the height of the chamber structure is increased, and the enlarged refrigeration space formed therefrom is filled with a cooling liquid; a heat conducting pipe is fixedly positioned inside the refrigeration space, wherein the heat conducting pipe is a closed cycle type, the upper portion of which contacts the temperature equalization plate, and a superconducting pipe is disposed in the interior of the refrigeration space; the superconducting pipe is a helical multi-ring configuration, one end of which is connected to the bottom end of the return outlet flow pipe and another end is connected to the bottom end of the return inlet flow pipe; the inlet is provided on the upper cover and the outlet is provided on the bottom portion of the chamber structure.

* * * * *